US012584192B2

(12) United States Patent
Sams et al.

(10) Patent No.: US 12,584,192 B2
(45) Date of Patent: Mar. 24, 2026

(54) LITHIUM PURIFICATION AND CONVERSION

(71) Applicant: Schlumberger Technology Corporation, Sugar Land, TX (US)

(72) Inventors: Gary W. Sams, Spring, TX (US); Florence Binet, Houston, TX (US); Rod William Shampine, Houston, TX (US); Dominic Vincent Perroni, Houston, TX (US)

(73) Assignee: Schlumberger Technology Corporation, Sugar Land, TX (US)

( * ) Notice: Subject to any disclaimer, the term of this patent is extended or adjusted under 35 U.S.C. 154(b) by 0 days.

(21) Appl. No.: 18/052,647

(22) Filed: Nov. 4, 2022

(65) Prior Publication Data

US 2023/0088458 A1 Mar. 23, 2023

Related U.S. Application Data

(63) Continuation of application No. 17/815,593, filed on Jul. 28, 2022, now abandoned.

(60) Provisional application No. 63/203,777, filed on Jul. 30, 2021.

(51) Int. Cl.
*C22B 26/12* (2006.01)
*C22B 3/42* (2006.01)

(52) U.S. Cl.
CPC ..... *C22B 26/12* (2013.01); *C22B 3/42* (2013.01)

(58) Field of Classification Search
CPC ..... C22B 26/12; C22B 3/42; Y02P 10/20
See application file for complete search history.

(56) References Cited

U.S. PATENT DOCUMENTS

| | | | |
|---|---|---|---|
| 3,306,700 | A | 2/1967 | Neipert |
| 4,291,001 | A | 9/1981 | Repsher |
| 4,727,936 | A | 3/1988 | Mioduszewski |
| 5,681,477 | A | 10/1997 | Leavitt |
| 5,833,844 | A | 11/1998 | Leavitt |
| 6,073,448 | A | 6/2000 | Lozada |
| 9,068,247 | B2 | 6/2015 | Marston |
| 9,976,417 | B2 | 5/2018 | Mahavadi |
| 10,018,590 | B2 | 7/2018 | Mahavadi |
| 11,169,114 | B2 | 11/2021 | Mahavadi |
| 11,298,658 | B2 | 4/2022 | Wohlert |

(Continued)

FOREIGN PATENT DOCUMENTS

| | | | |
|---|---|---|---|
| CN | 1511964 | A | 7/2004 |
| CN | 104313348 | A | 1/2015 |

(Continued)

OTHER PUBLICATIONS

Nan et al. CN111635998B English (Year: 2021).*

(Continued)

*Primary Examiner* — Sally A Merkling
*Assistant Examiner* — Jordan W Taylor
(74) *Attorney, Agent, or Firm* — Kyle R. Miiller

(57) ABSTRACT

Lithium recovery processes are described using vaporization and conversion techniques. A vaporizer can be used to concentrate lithium and precipitate impurities. A conversion process can be used to replace anions in lithium bearing streams by adding a second anion and precipitating lithium in a salt with the second anion. Rotary separation can be used to separate the precipitated lithium salt.

10 Claims, 5 Drawing Sheets

(56) References Cited

U.S. PATENT DOCUMENTS

| | | | | |
|---|---|---|---|---|
| 11,365,128 | B2 | 6/2022 | Marston | |
| 11,941,128 | B2 | 3/2024 | Andersen | |
| 2003/0132113 | A1 | 7/2003 | Sarme | |
| 2006/0163069 | A1 | 7/2006 | Prak | |
| 2009/0269767 | A1 | 10/2009 | Soderlund | |
| 2010/0068605 | A1 | 3/2010 | Harris | |
| 2011/0174739 | A1 | 7/2011 | Chung | |
| 2012/0103826 | A1* | 5/2012 | Gordon | C01D 15/02 204/522 |
| 2013/0205778 | A1 | 8/2013 | Hansen | |
| 2014/0048485 | A1 | 2/2014 | Jacobs | |
| 2014/0076734 | A1 | 3/2014 | Calvo | |
| 2014/0239224 | A1 | 8/2014 | Burba | |
| 2015/0114837 | A1 | 4/2015 | Mahavadi | |
| 2015/0197830 | A1 | 7/2015 | Chon | |
| 2016/0221833 | A1* | 8/2016 | Zhu | F24S 30/452 |
| 2017/0045476 | A1 | 2/2017 | Mahavadi | |
| 2017/0102370 | A1 | 4/2017 | Alber | |
| 2017/0175228 | A1* | 6/2017 | Hunwick | C01D 15/08 |
| 2018/0016153 | A1 | 1/2018 | Sharma | |
| 2018/0147532 | A1* | 5/2018 | Switzer | B01D 61/58 |
| 2018/0207584 | A1 | 7/2018 | Chang | |
| 2018/0245180 | A1* | 8/2018 | Cheng | B01J 20/28004 |
| 2019/0120791 | A1 | 4/2019 | Al-Gouhi | |
| 2019/0226336 | A1 | 7/2019 | Benson | |
| 2019/0248667 | A1 | 8/2019 | Featherstone et al. | |
| 2019/0256368 | A1* | 8/2019 | Marston | B01D 15/125 |
| 2020/0047124 | A1* | 2/2020 | Bhave | B01D 69/04 |
| 2020/0189924 | A1 | 6/2020 | Featherstone et al. | |
| 2020/0283921 | A1 | 9/2020 | Mislan | |
| 2020/0299805 | A1* | 9/2020 | Mceachern | B01J 20/18 |
| 2020/0316557 | A1 | 10/2020 | Boualleg | |
| 2020/0399772 | A1 | 12/2020 | Kiggins | |
| 2021/0086400 | A1 | 3/2021 | Andersen | |
| 2021/0087697 | A1 | 3/2021 | Riabtsev et al. | |
| 2022/0055910 | A1 | 2/2022 | Jariwala et al. | |
| 2022/0395780 | A1 | 12/2022 | Bhave | |
| 2023/0032153 | A1 | 2/2023 | Sams et al. | |
| 2023/0086861 | A1 | 3/2023 | Perroni et al. | |
| 2023/0125398 | A1 | 4/2023 | Abdelaal | |
| 2023/0356107 | A1 | 11/2023 | Sams | |
| 2023/0364560 | A1 | 11/2023 | Sams | |
| 2023/0366062 | A1 | 11/2023 | Sams | |
| 2024/0165539 | A1 | 5/2024 | Sams | |
| 2024/0308865 | A1 | 9/2024 | Perroni | |

FOREIGN PATENT DOCUMENTS

| | | | | |
|---|---|---|---|---|
| CN | 111635998 | B * | 7/2021 | C22B 1/02 |
| JP | 2011032151 | A | 2/2011 | |
| JP | 2018172775 | A | 11/2018 | |
| JP | 2021017627 | A * | 2/2021 | |
| RU | 2688593 | | 5/2019 | |
| WO | 2006103312 | A1 | 10/2006 | |
| WO | 2012044163 | A1 | 4/2012 | |
| WO | 2018081506 | A1 | 5/2018 | |
| WO | 2018183555 | A1 | 10/2018 | |
| WO | 2018190754 | A2 | 10/2018 | |
| WO | 2019160982 | A1 | 8/2019 | |
| WO | 2019221932 | A1 | 11/2019 | |
| WO | 2021061343 | A1 | 4/2021 | |
| WO | 2021160240 | A1 | 8/2021 | |
| WO | 2021228936 | A1 | 11/2021 | |
| WO | 2022040630 | A1 | 2/2022 | |
| WO | 2022203706 | A1 | 9/2022 | |
| WO | 2023009887 | A1 | 2/2023 | |
| WO | 2023009888 | A1 | 2/2023 | |
| WO | 2023022627 | A1 | 2/2023 | |
| WO | 2023177994 | A1 | 9/2023 | |
| WO | 2023183546 | A1 | 9/2023 | |

OTHER PUBLICATIONS

Miho et al. JP2021017627A English (Year: 2021).*

Refrigeration, https://energyrecovery.com/refrigeration/, downloaded on Aug. 14, 2021 (5 pages).

Ferrara et al., (2015) A Small Power recovery expander for heat pump COP improvement, Energy Procedia 81 (015) 1151-1159.

Turbomachine expander offers efficient, safe strategy for heating, cooling, https://www.purdue.edu/newsroom/releases/2020/Q1/turbomachine-expander-offers-efficient,-safe-strategy-for-heating,-cooling.html, downloaded on Aug. 15, 2021 (5 pages).

Turkia, et al., Online Capillary Electophoresis for Monitoring Carboxylic Acid Production by Yeast during Bioreactor Cultivations, Anal. Chem. 2013, 85, 9705-97.

Watercycle Technologies, "Technology", 2022, accessed Sep. 19, 2024, https://www.watercycletechnologies.com/technology, 6 pages.

KMX Technologies, "Technology", 2024, accessed Sep. 19, 2024, https://kmxtechnologies.com/kmx-technology/, 9 pages.

Xu, W. et al., "A Comprehensive Membrane Process for Preparing Lithium Carbonate from High Mg/Li Brine", Membranes, 2020, 10, 14 pages.

Kumar, A. et al., "Metals Recovery from Seawater Desalination Brines: Technologies, Opportunities and Challenges", ACS Sustainable Chemistry & Engineering 2021, 9, 7704-7712.

Zhao, X. et al., "Review on the electrochemical extraction of lithium from seawater/brine", Journal of Electroanalytical Chemistry 2019, 850, 113389, 13 pages.

Yang, S. et al., "Lithium Mteal Extraction from Seawater", Joule, 2018, 2, pp. 1648-1651.

Liu, C. et al., "Lithium Extraction from Seawater through Pulsed Electrochemical Intercalation", Joule 2020, 4, pp. 1459-1469.

Li, Z. et al., "Continuous electrical pumping membrane process for seawater lithium mining", Energy & Environmental Science 2021, 14, pp. 3152-3159.

International Search Report and Written Opinion issued in the PCT Application No. PCT/US2021/047156 dated Nov. 25, 2021, 11 pages.

International Preliminary Report on Patentability of International Patent Application No. PCT/US2021/047156 dated Mar. 2, 2023, 8 pages.

International Search Report and Written Opinion issued in the PCT Application No. PCT/US2023/020954 dated Jul. 10, 2023, 12 pages.

International Search Report and Written Opinion issued in the PCT Application No. PCT/US2023/020957 dated Jul. 10, 2023, 12 pages.

International Search Report and Written Opinion issued in the PCT Application No. PCT/US2022/051500 dated May 2, 2023, 12 pages.

* cited by examiner

LITHIUM PURIFICATION AND CONVERSION

CROSS-REFERENCE TO RELATED APPLICATIONS

This patent application is a continuation of application Ser. No. 17/815,593 filed Jul. 28, 2022, which is entirely incorporated herein by reference, and which claims the benefit of U.S. Provisional Patent Application Ser. No. 63/203,777 filed Jul. 30, 2021, which is entirely incorporated herein by reference.

FIELD

This patent application describes methods and apparatus for lithium recovery from aqueous sources. Specifically, processes and apparatus for concentrating and converting lithium in brine streams are described.

BACKGROUND

Lithium is a key element in energy storage. Electrical storage devices, such as batteries, supercapacitors, and other devices commonly use lithium to mediate the storage and release of chemical potential energy as electrical current. As demand for renewable, but non-transportable, energy sources such as solar and wind energy grows, demand for technologies to store energy generated using such sources also grows.

According to the United States Geological Survey, global reserves of lithium total 21 million tons (metric) of lithium content, with Chile, Australia, Argentina, and China accounting for about 82% of global reserves. U.S. Geological Survey, Mineral Commodity Summaries, January 2021. Global production of lithium content was 82 kT in 2020 and 86 kT in 2019. Global consumption was estimated at 56 kT in both 2019 and 2020. Id. By one estimate, global lithium demand is expected to reach 1.79 MTa of lithium carbonate equivalent, which is approximately 339 kTa of lithium content, by 2030 for an average annual growth in demand of approximately 22%. Supply is currently forecast to run behind demand, with lithium prices expected to triple by 2025, by some estimates. The incentive for more lithium production could not be clearer.

The mining industry has numerous techniques for the extraction of lithium from mineral or saline waters. Hard rock mining with acid digestion is common, but labor intensive. Methods currently used for salar lakes involve evaporation ponds with chemical additives to selectively precipitate the lithium. This process requires months to complete and typically recovers roughly 50-60% of the original lithium.

In recent years, companies are investigating improved methods to recover lithium directly from salar lakes that avoid pond evaporation, are faster and have high lithium yield. Many techniques use adsorbents that selectively recover lithium, followed by a wash step that liberates the lithium for further processing. Solid and liquid adsorbents are used. Processing brine streams involves handling large volumes of water to access the lithium contained in the brine. Efficient and effective means of separating lithium from water are needed.

SUMMARY

Embodiments described herein provide a method of recovering lithium from a brine source, comprising extracting lithium from the brine source using an adsorption/desorption process to form a lithium extract; and concentrating the lithium extract during a concentration stage to yield a lithium concentrate stream, wherein the concentration stage includes using a series of membrane separations to separate a brine stream with high lithium concentration, as a non-permeating stream, from a brine stream with low lithium concentration, as a permeating stream.

Other embodiments described herein provide a method of recovering lithium from a brine source, comprising extracting lithium from the brine source using an adsorption/desorption process to form a lithium extract; and concentrating the lithium extract during a concentration stage to yield a lithium concentrate, wherein the concentration stage includes using a membrane separation process with a plurality of membrane separations in series operated in countercurrent format.

DETAILED DESCRIPTION

Figure 1:
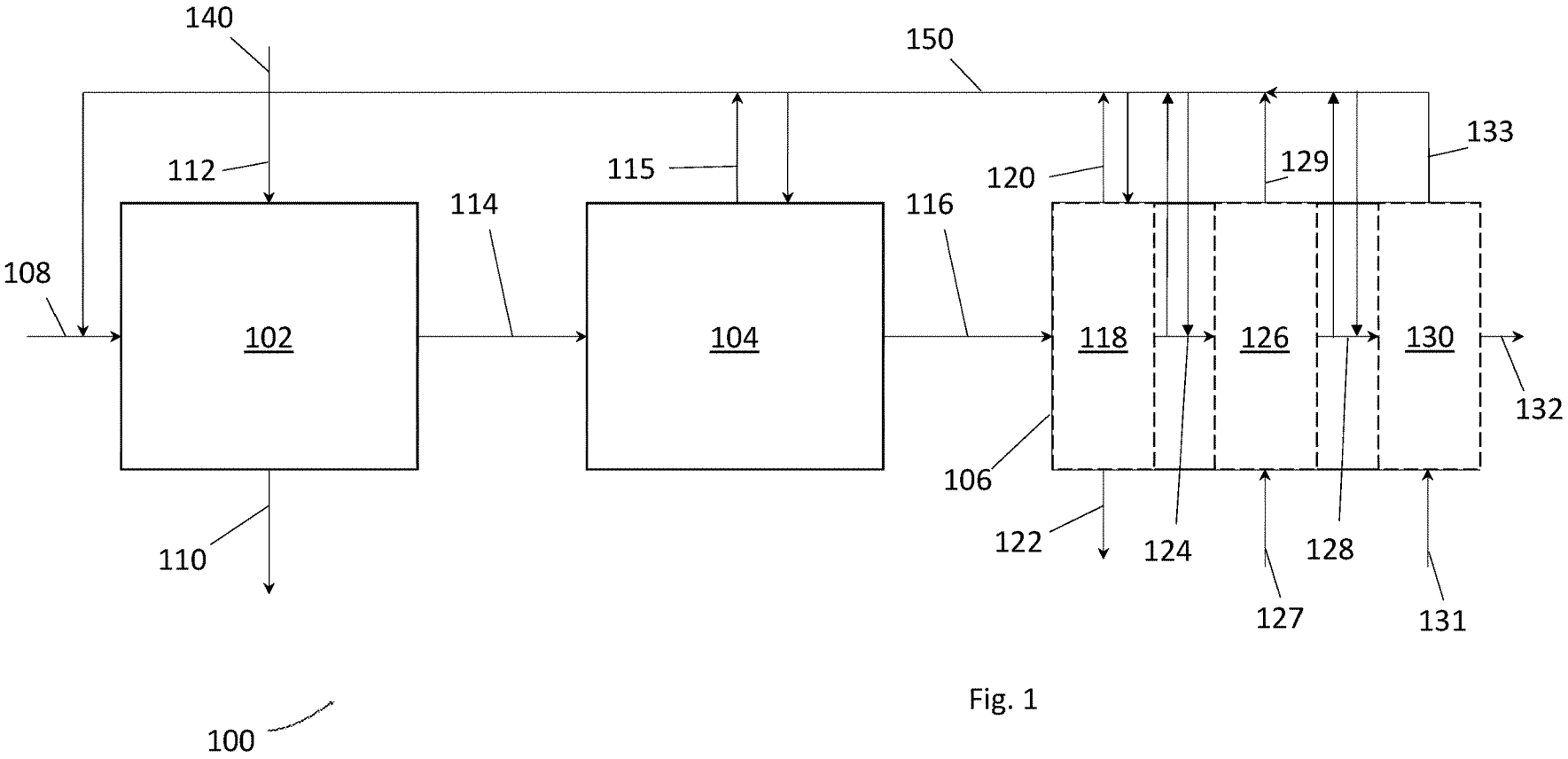
FIG. 1 is a process diagram summarizing a lithium recovery process according to one embodiment.

FIG. 1 is a process diagram summarizing a lithium recovery process 100 according to one embodiment. The process 100 has an ion withdrawal stage, such as an extraction stage 102, a concentration stage 104, and a conversion stage 106. In the extraction stage 102, an aqueous stream containing lithium, typically mostly lithium chloride, is contacted with a lithium-selective medium, which may be liquid or solid. The medium withdraws lithium from the aqueous stream, which is returned to the environment depleted of lithium. The medium may adsorb or absorb lithium from the aqueous stream. The process of withdrawing lithium from the aqueous stream is an ion withdrawal process wherein lithium ions, and lower amounts of other ions, are withdrawn from the aqueous solution into the medium, either at the surface of a solid medium, into the interior of a solid medium, or into a liquid medium.

A brine source stream 108 is provided to the extraction stage 102 for contacting with the lithium selective medium. A lithium depleted brine stream 110 exits the extraction stage 102 for return to the environment. The lithium depleted brine stream 110 may be treated before return to the environment, for example using a filtration or other separation process (e.g. filtering, settling, centrifugation) to remove any impurities. An eluent stream 112 is contacted with the lithium-loaded medium to release the lithium into the eluent stream 112 to form a lithium extract stream 114. Where the medium is a liquid, a separate lithium unloading vessel (not shown) may be used as part of the extraction stage 102 to contact the loaded medium with the eluent. The composition and volume of the eluent stream 112, prior to contacting with the loaded medium, may be controlled to achieve a desired composition of the lithium extract stream 114. For example, flow rate of the eluent stream 112 may be controlled to achieve a desired lithium concentration in the lithium extract stream 114. In this way, lithium concentration may be arbitrarily chosen, up to the solubility limit of the lithium salts in the aqueous lithium extract stream 114. Recycle streams from other parts of the process may be included in the eluent stream 112 to target a desired composition of the eluent stream 112, for example to minimize impurities or to target a lithium composition of the eluent stream 112.

The lithium extract stream 114 is provided to the concentration stage 104 to separate water from the lithium, which is typically mostly lithium chloride at this stage. The concentration stage 104 includes operations that selectively separate water from lithium. These operations include membrane operations and selective filtration operations. In one embodiment, a series of membrane separations is performed to separate a brine stream with high lithium concentration, as a non-permeating stream, from a brine stream with low lithium concentration, as a permeating stream. The permeating stream, in this case, will also contain most impurities from the lithium extract stream 114. The concentration stage 104 yields a lithium concentrate stream 116, which may have a solution lithium concentration of up to about 4 wt % lithium, of which most, perhaps about 90%, is lithium chloride. Impurities that might impede the concentration processes of the concentration stage 104, such as divalent ions in the case of membrane operations, may be removed from the lithium extract stream 114 prior to concentration in the concentration stage 104.

The concentration stage 104 also produces a dilute brine stream 115 that can be recycled to the extraction stage for use as eluent or recycle to the brine source stream 108. The dilute brine stream 115 may be the membrane permeating stream and/or material used to perform membrane sweep operations to remove any solids buildup on the membranes. In general, the dilute brine stream 115 contains water and most impurities separated from the lithium concentrate stream 116. Where the dilute brine stream contains more impurities than desired, the dilute brine stream can be recycled to the brine source stream 108 so that the impurities from the dilute brine stream will pass to the lithium depleted stream 110 to be removed from the process. Alternately, where an impurity removal process is used with the concentration stage 104, recycling the dilute brine stream 115 to the eluent 112 can result in any impurities of the dilute brine stream 115 being treated by the impurity removal process.

The lithium concentrate stream 116 is provided to the conversion stage 106. The conversion stage 106 is energy intensive, so a concentration operation is performed prior to conversion of the lithium. A vaporizer 118 is used to further concentrate the lithium salt in the lithium concentrate stream 116 from a low level, such as 4 wt % LiCl, to a higher level, such as about 15 wt % LiCl, prior to conversion. The vaporizer 118 yields a vaporizer water stream 120, which can be recycled to the concentration stage 104, as a dilution, sweep, or thermal integration stream, or to the extraction stage 102 as eluent or feed dilution. The vaporizer 118 also yields an impurity stream 122, which contains non-lithium cations such as sodium, potassium, magnesium, manganese, calcium, and the like. The vaporizer 118 also yields a lithium pre-conversion stream 124, which can have lithium concentration of 15 wt % or more, and which is provided to a first conversion operation 126.

The first conversion operation 126 uses a sodium carbonate stream 127, also referred to as a sodium carbonate reagant stream, to convert lithium chloride to a first conversion stream 128 that exits the first conversion operation 126 as a slurry of lithium carbonate in water. Water that enters the first conversion operation 126 with the lithium pre-conversion stream 124 and the sodium carbonate stream 127 is at least partially removed in a first conversion recycle stream 129. The first conversion recycle stream 129 can be recycled to the vaporizer 118, to the concentration stage 104, or to the extraction stage 102 as feed or eluent.

The first conversion stream 128 is provided to a second conversion operation 130 to convert the lithium carbonate into lithium hydroxide. A calcium hydroxide stream 131, also referred to as a calcium hydroxide reagant stream, is provided to the second conversion operation 130 to convert the lithium carbonate of the first conversion stream 128 into lithium hydroxide, which exits the second conversion operation 130 as a lithium hydroxide stream 132, which may be a slurry, paste, or dry solid. The lithium hydroxide stream 132 is a product stream of the process 100. The lithium hydroxide stream 132 may also be referred to as a lithium hydroxide product. Water entering the second conversion operation 130 with the first conversion stream 128 and the calcium hydroxide stream 131 is at least partially removed in a second conversion recycle stream 133, which can be recycled to the vaporizer 118, the concentration stage 104, or the extraction stage 102 as feed diluent or as eluent.

The various water recycle streams form a water circuit 150 that is used to optimize use of water in the process 100, potentially along with energy use and removal of impurities. Reagent streams 127 and 131 are input to the process 100, along with any other reagent streams for optional impurity removal processes. Any impurities that enter the process 100 in the reagent streams are generally captured in the water circuit 150 and recycled to upstream processes, effectively counterflowing impurities to the extraction stage 102 for removal in the lithium depleted brine stream 110. Water handling can be optimized to minimize use of a water makeup 140 at the eluent 112 of the extraction stage 102.

Streams containing lithium and/or impurities can also be recycled. As shown in FIG. 1, some or all of the lithium pre-conversion stream 124 can be recycled to the vaporizer 118, the concentration stage 104, the extraction stage 102, or to the brine source stream 108. Likewise, some or all of the first conversion stream 128 can be recycled to the vaporizer 118, the concentration stage 104, the extraction stage 102, or to the brine source stream 108. The various anions that are introduced in later stages of the process 100, such as carbonate and hydroxide, can be managed by adjusting addition of carbonate and hydroxide reagents depending on residual carbonate and hydroxide content of various streams in the process, which can be ascertained by any convenient analytical method, including use of in-line instruments (e.g. spectroscopy instruments and titrators).

Figure 2:
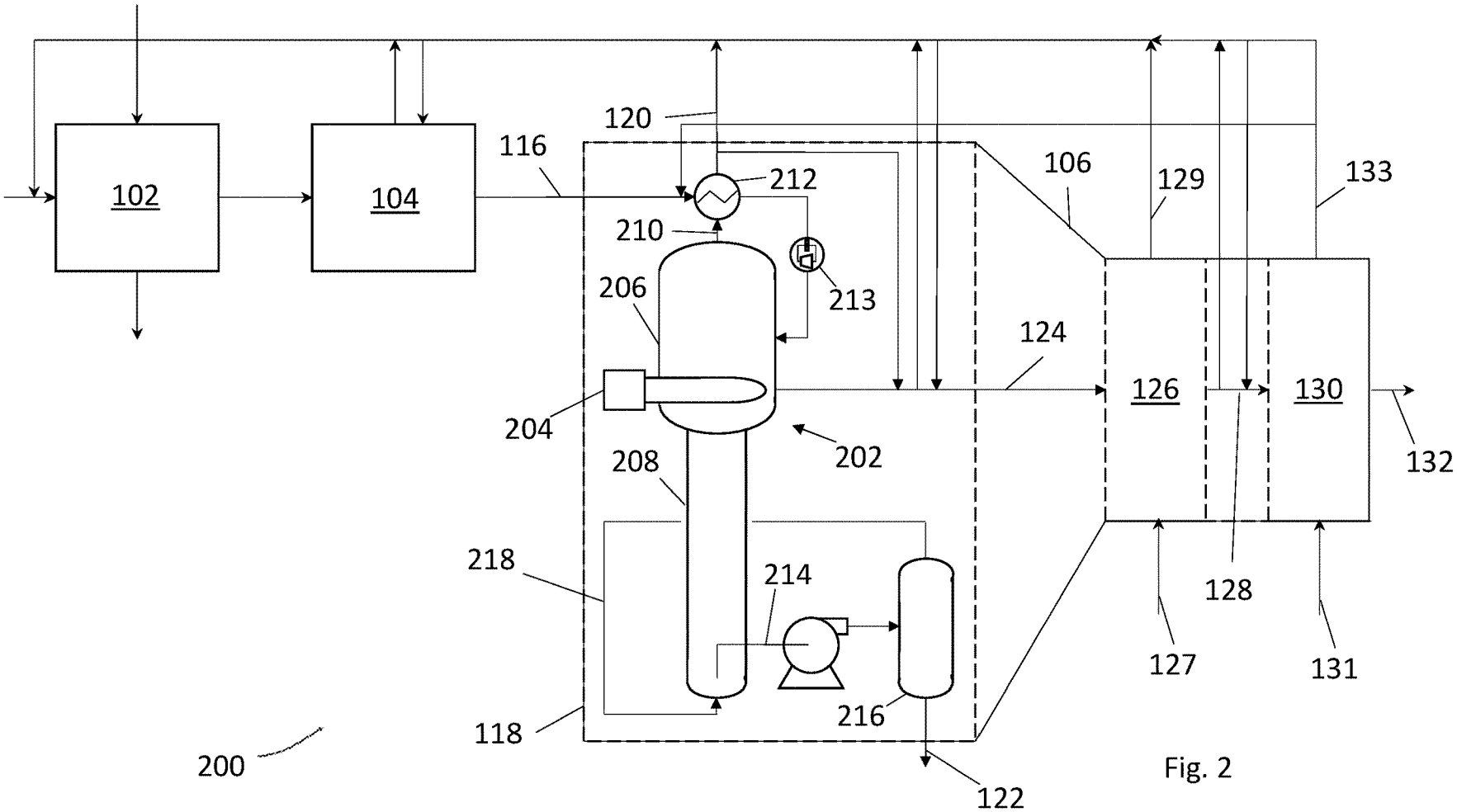
FIG. 2 is a process diagram summarizing a lithium recovery process according to another embodiment.

FIG. 2 is a process diagram summarizing a lithium recovery process 200 according to another embodiment. The process 200 is similar in many respects to the process 100, and identical features of the processes 100 and 200 are labeled using the same reference numerals. A vaporization vessel 202 receives the lithium concentrate stream 116. Heat is applied to the lithium concentrate stream 116 within the vaporization vessel 202 to vaporize water and concentrate lithium and other ions within the vessel 202. A heater 204 is coupled to the vessel 202 to apply heat to the fluid within the vessel 202. The heater 204 is shown here schematically as an element inserted into the interior of the vessel 202, but heat input can be accomplished in any convenient manner.

The vessel 202 generally has a vaporization section 206 and a precipitation section 208. Solids precipitate from the fluid as water is vaporized and solubility limits are reached. The vaporizer 118 is therefore also a precipitator of solids. Sodium precipitates as sodium chloride, and potentially other salts due to trace amounts of other anions. Lithium generally remains in a concentrated solution, but some lithium salts can precipitate if enough water is removed by evaporation. Sodium solids generally settle below the lithium-rich solution due to density. The lithium solution is removed as the lithium pre-conversion stream 124, which is removed from a lower part of the vaporization section 206. Vaporized water is removed in an overhead stream 210 of the vaporization section 206. Heat is recovered from the vaporized water by thermally contacting the vaporized water with the lithium concentrate stream 116 in a heat exchanger 212. The heated lithium concentrate stream 116 is provided to the vaporization section 206 of the vessel 202, optionally using a valve or orifice to flash the heated lithium concentrate stream 116 within the vaporization section 206. The vaporized water is at least partially condensed in the heat exchanger 212, and a portion of the vaporized water is added to the lithium pre-conversion stream 124 to ensure all the lithium in the lithium pre-conversion stream 124 is dissolved for the next conversion process. The remaining vaporized water exits as the vaporizer water stream 120. Additional heat can be added to the lithium concentrate stream 116 using an optional heat pump 213 located downstream of the heat exchanger 212 to maximize recovery of thermal energy from the overhead stream 210.

Sodium solids, mainly chloride, along with other impurities such as calcium, potassium, magnesium, and manganese, also including any anion impurities, also precipitate in the vaporization section 206 of the vessel 202, and due to higher density than the concentrated lithium solution settle into the precipitation section 208. Note that the vaporization section 206 of the vessel 202 is sized to provide residence time for sodium precipitates to settle into the precipitation section 208. A precipitate stream 214 is withdrawn from a lower portion of the precipitation section 208 and pumped to a settling vessel 216. The sodium solids, along with other dense impurities, settle in the settling vessel 216 and are removed as the impurity stream 122. Separated water or brine is withdrawn from the settling vessel 216 and returned to the vaporization vessel 202 as a vaporization return stream 218. In this case, the water or brine is returned at the bottom of the precipitation section 208 to fluidize solids that may collect at the bottom of the precipitation section 208. The water or brine, or a portion thereof, can be returned to the vaporization vessel 202 at other points, or may be routed to other uses.

Where convenient, various downstream water and brine streams containing lithium, and potentially impurities, can be recycled, in part or in total, to the vaporizer 118 to blend with the lithium concentrate stream 116 upstream of the heat exchanger 212. These streams include the pre-conversion stream 124, the first conversion stream 128, the first conversion recycle stream 129, and the second conversion recycle stream 133. These streams can be mixed and recycled to any convenient extent to manage the lithium content and volume of the stream provided to the vaporization section 206 of the vaporizer 118. For example, a level instrument can sense a liquid level in the vaporization section 206, and a controller operatively coupled to the level instrument can control volume of recycle from these downstream streams to the vaporizer 118 to maintain the liquid level in the vaporization section 206 without impacting overall lithium throughput of the process 200 (i.e. flow rate of the lithium concentrate stream 116).

The vaporizer 118 can be used to concentrate any lithium stream having any input concentration of lithium. For example, the vaporizer 118 could be used to directly concentrate lithium from the brine source stream 108, without use of the extraction stage 102 and the concentration stage 104. A portion of the brine source stream 108 could also be routed directly to the vaporizer 118, bypassing the extraction stage 102 and the concentration stage 104, for example to optimize capacity utilization of the various operations. Impurities in the brine source stream 108 would be directly precipitated by rising concentration in the vaporizer 118, and would be removed in the settling vessel 216.

Figure 3:
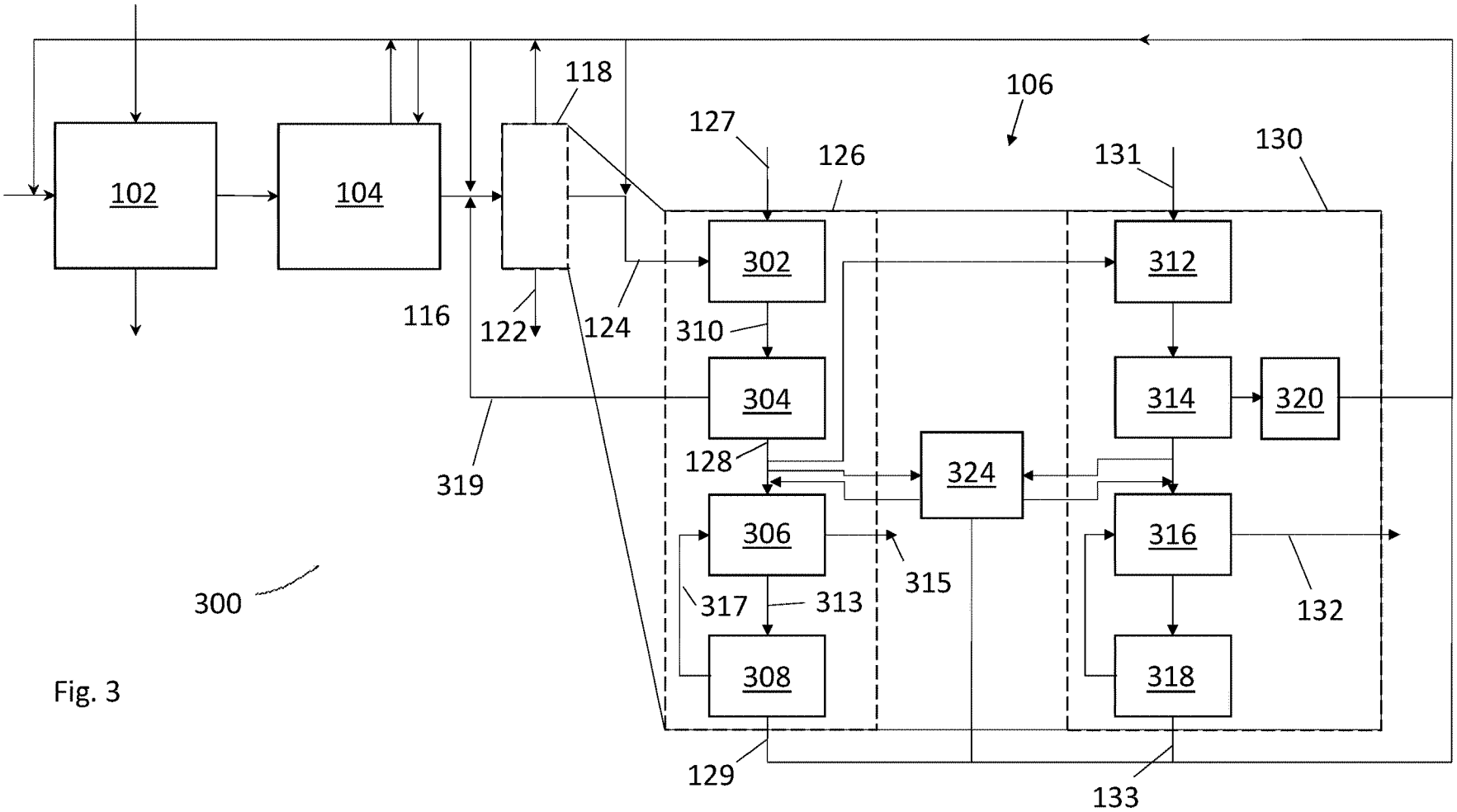
FIG. 3 is a process diagram of a lithium recovery process according to another embodiment.

FIG. 3 is a process diagram summarizing a lithium recovery process 300 according to another embodiment. The process 300 is similar in many respects to the processes 100 and 200, and features of the process 300 that are identical to features of the processes 100 and 200 are labeled using the same reference numerals. Details of the conversion operations 126 and 130 are shown in FIG. 3. The conversion operations 126 and 130 are similar. Both operations include a mixing and reaction process, a rotary separation process, a drying process, and a water recovery process. The first conversion operation 126 uses a mixing vessel 302, a rotary separator 304, a dryer 306, and a condenser 308. The second conversion operation 130 also uses a mixing vessel 312, a rotary separator 314, a dryer 316, and a condenser 318, but also uses a filtration unit 320. One or more concentration stages 104 can also be included in the conversion stage 106 to reduce energy consumption of the dryers 306 and 316.

The pre-conversion stream 124, containing up to 15 wt % lithium salt (typically as mostly lithium chloride) in solution, is provided to the mixing vessel 302. The sodium carbonate stream 127 is also provided to the mixing vessel 302 where the two streams are mixed and allowed to react. Lithium carbonate precipitates. The extent of lithium carbonate removal as precipitate depends on the amount of sodium carbonate added to the reaction and on the temperature of the medium. Lithium carbonate precipitation, and conversion from lithium chloride, can be encouraged by operating the mixing vessel at elevated temperature, for example 80° C. to 90° C. Thermal tools, such as heaters and the like (not shown), can be used to target temperatures of streams as desired.

A reaction mixture 310 is passed from the mixing vessel 302 to the rotary separator 304, which may be a centrifuge or hydrocyclone. Rotary separation results in separation of materials according to density, such that a stream rich in lithium carbonate can be separated from the remaining liquor as the first conversion stream 128. The remaining liquor may contain sodium carbonate, sodium chloride, lithium chloride, and lithium carbonate. To maximize separation in the rotary separator 304, the contents of the rotary separator 304 are maintained at an elevated temperature to maximize lithium carbonate solids. To maximize lithium recovery, the separated liquor can be recycled, as a conversion recycle stream 319, to the vaporizer 118. In this case, the conversion recycle stream 319 is mixed with the lithium concentrate stream 116 prior to entering the vaporizer 118, but the conversion recycle stream 319 can be provided to the vaporizer 118 in any convenient manner. For example, the conversion recycle stream 319 can be mixed with the lithium concentrate stream 116, and the mixed stream flowed through the heat exchanger 212 (FIG. 2) into the vaporization section 206. Alternately, the conversion recycle stream 319 can be provided directly to the vaporization section 206, or to the precipitation section 208, preferably near the location where the vaporization section 206 and the precipitation section 208 join.

If desired, a lithium carbonate product may be recovered in the first conversion operation 126. All, or a portion, of the first conversion stream 128 may be provided to the dryer 306 where a gas stream 317 is used to remove moisture and form a lithium carbonate product 315, which may be a paste or powder. The lithium carbonate product 315 may also be referred to as a lithium carbonate stream. The gas can be air, nitrogen, or other gas, or mixture thereof, that is non-reactive with lithium carbonate. A moist gas stream 313 is routed to the condenser 308 to condense a water stream that exits as the first conversion recycle stream 129. The dried gas is recycled to the dryer 306 as the gas stream 317. The dryer 306 can be used to recover water added to the process in the sodium carbonate reagent stream 127. In such cases, recovery of a lithium carbonate product might not be desired, so the lithium carbonate can be concentrated to any desired extent and the lithium carbonate stream 315, not a product in this case but an intermediate material, can be recycled or rejoined with the first conversion stream 128.

The second conversion operation 130 is similar to the first conversion operation 126. The first conversion stream 128, containing lithium carbonate, is provided to the mixing vessel 312. The calcium hydroxide stream 131 is also provided to the mixing vessel 312, reacting with the lithium carbonate to precipitate calcium carbonate. In this case, elevated temperature, for example 80° C. to 90° C., encourages reaction, but also encourages lithium hydroxide to remain in solution. The reaction medium is provided to the rotary separator 314, where calcium carbonate is separated from the lithium hydroxide solution. The separated calcium carbonate is provided, as a slurry, to the filtration unit 320 for packing into a solid manageable form. Recovered water can be recycled from the filtration unit 320 to any convenient part of the process 300.

The lithium hydroxide solution is provided to the dryer 316, which evaporates water and precipitates the lithium hydroxide product 132 as a powder or paste. The lithium hydroxide solution is exposed to a dry gas stream to remove water. In this case, the gas does not contain carbon dioxide, in order to avoid converting any lithium hydroxide to lithium carbonate. Nitrogen, carbon-free air, or other suitably non-reactive gas or gas mixture can be used. Water is recovered from the moist gas of the dryer in the condenser 318, and water from the condenser 318 exits as the second conversion recycle stream 133, which can be combined with the first conversion recycle stream 129, if desired, and routed to any convenient part of the process 300 as recycle. The humidification-dehumidification processes described herein to remove water from lithium carbonate and lithium hydroxide solutions/slurries can be practiced using the CGE humidification-dehumidification process available from Gradient Corp., of Chennai, India.

The dryers 306 and 316 consume energy to evaporate water. To reduce the amount of water to be evaporated, a concentration stage 324 can be used to concentrate the lithium streams recovered in the rotary separators 304 and 314. One concentration stage 324, or two concentration stages 324, can be used, and water recovered in one or both concentration stages 324 can be recycled to any convenient location of the process 300. These concentration stages 324 can be similar, or the same as the concentration stage 104 used further upstream in the process 300. Specifically, each concentration stage 324 can be a membrane separation process, which can use a plurality of membrane separations in series and/or parallel arrangements, which can be selected according to the separation needs of specific processes. The plurality of membrane separations in a given process can be operated in co-current format, where permeate and non-permeate streams generally flow from one membrane to the next together, counter-current format, where permeate and non-permeate streams generally flow from membrane to membrane in opposite sequential orientations, or a mixture thereof. In general, the concentration stage 324 would receive a lithium bearing stream from the rotary separator, 304 and/or 314, separate a purified lithium bearing stream by separating water into a permeate stream, and might return the lithium bearing stream to the dryer, 306 and/or 316, with the separated dilute stream being available for recycling. The lithium bearing stream can also be routed to the extraction stage 102, the vaporizer 118, and/or to the mixing vessel 302. Impurity levels in the lithium bearing streams may determine recycle route of the lithium bearing stream from the concentration stage 324 in the process 300.

Figure 4A:
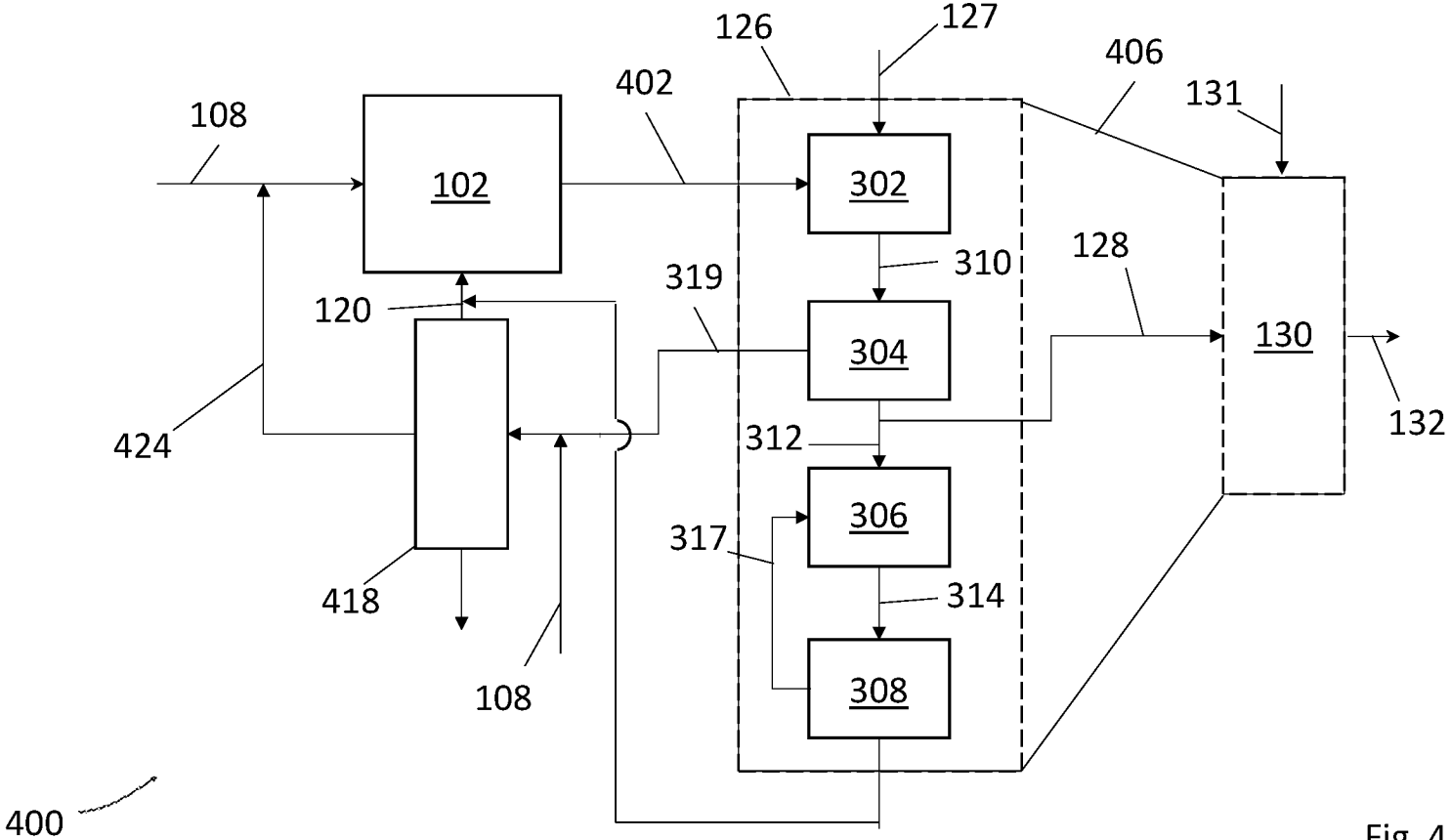
FIGS. 4A and 4B are process diagrams summarizing lithium recovery processes according to other embodiments.

FIG. 4A is a process diagram summarizing a lithium recovery process 400, according to another embodiment. In the process 400, a vaporizer 418 is used to separate water from the conversion recycle stream 319 and to yield a lithium recycle stream 424, which is routed to the extraction stage 102. In this case, the extraction stage 102 produces a lithium extract 402 that is routed directly to the first conversion operation 126 of a conversion stage 406, which comprises the first conversion operation 126 and the second conversion operation 130. In the process 400, no concentration stage is used because the vaporizer 418 performs the impurity removal that would ordinarily result from the concentration stage. Because the extraction stage 102 can yield a lithium extract 402 with arbitrary lithium concentration, the concentration stage is not used. Water separated in the dryer 306 is returned to the extraction stage 102 as eluent, along with water vaporized in the vaporizer 418. Here, the brine source stream 108 can be provided to the vaporizer 418, in addition to or instead of directly to the extraction stage 102.

Figure 4B:
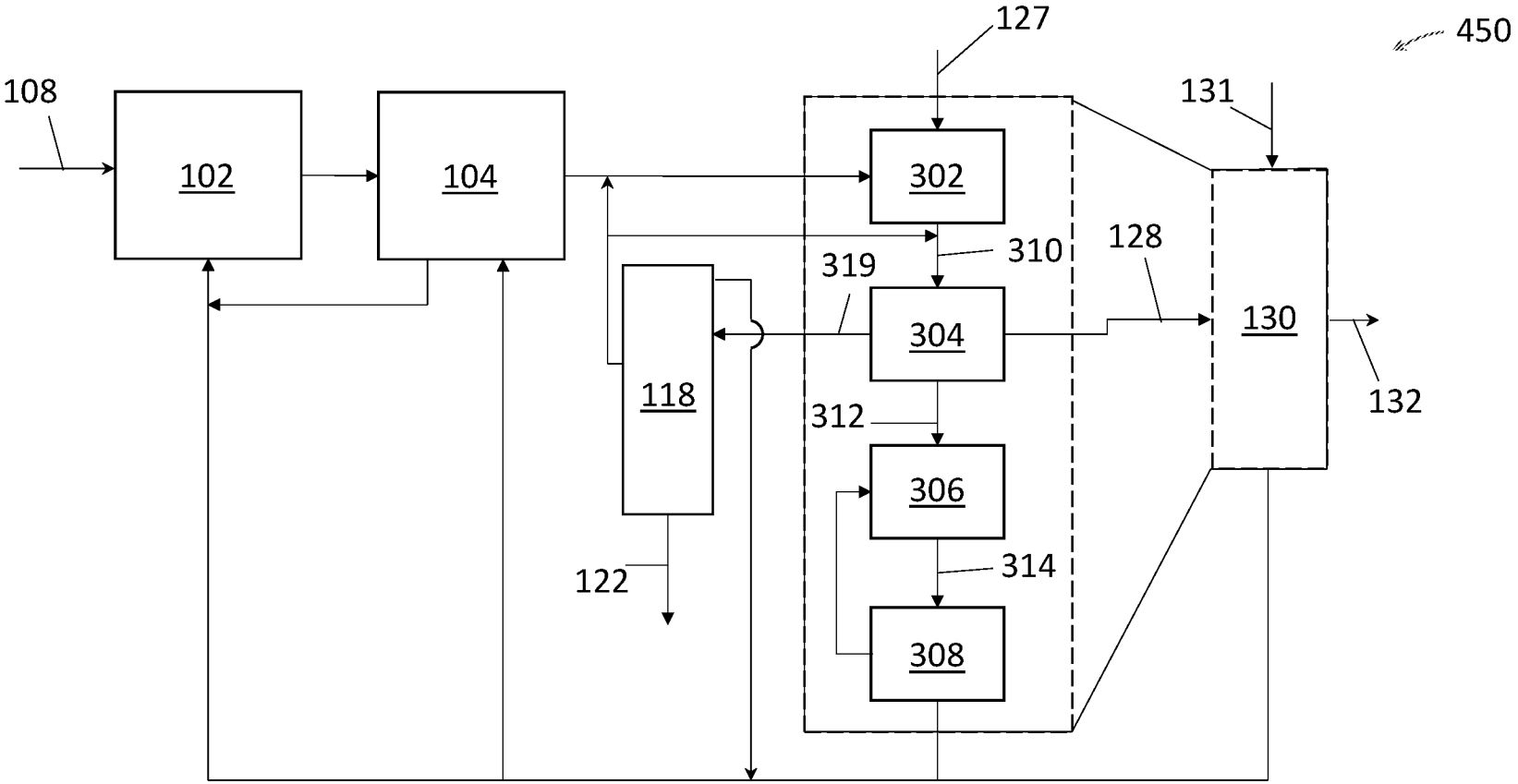

FIG. 4B is a process diagram summarizing a lithium recovery process 450, according to another embodiment. The process 450 is similar to the process 300, except that in the process 450, the vaporizer 118 is used to recover lithium not forwarded in the first conversion stream 128. The conversion recycle stream 319 is provided to the vaporizer 118, and lithium is returned to the rotary separator 304 or to the mixing vessel 302 for further recovery.

The processes 400 and 450 illustrate alternative uses of a vaporizer in various lithium recovery roles. It should be noted that multiple such vaporizers could be used in more than one of the roles described herein. That is to say, a lithium recovery process, as contemplated herein, could have a vaporizer used as a pre-conversion concentrator/purifier, as shown in FIGS. 1-3. The same process could additionally have a vaporizer used as a feed purifier and/or a conversion recycle purifier, as shown in FIG. 4A. The same process could additionally have a vaporizer used only as a conversion purifier, as shown in FIG. 4B. It should also be noted that in the processes 400 and 450, membrane concentrators can be used instead of, or in addition to, vaporization concentrators. That is to say, the vaporizer 418 in FIG. 4A could be a membrane concentration stage, or a combination membrane/vaporizer concentration stage. The vaporizer 118 in FIG. 4B could be replaced by a membrane concentration stage or by a combination membrane/vaporizer concentration stage.

Finally, it should also be noted that the first and second conversion processes, in their various implementations described herein, can be used independent of any extraction processes or concentration processes, and independent of each other. For example, a lithium salt stream can be provided to the first conversion process and can be converted to lithium carbonate as a stand-alone process. Likewise, a lithium carbonate stream can be provided to the second conversion process and can be converted to lithium hydroxide as a stand-alone process. Finally, it should be noted that the vaporization concentration processes described herein are not required for recovering lithium. Such vaporization processes may be helpful in recovering lithium in some cases, but as noted elsewhere herein, membrane concentration can generally be substituted for vaporization in most cases, and lithium recovery processes can be operated entirely without using the vaporizers described herein.

While the foregoing is directed to embodiments of the present invention, other and further embodiments of the present disclosure may be devised without departing from the basic scope thereof, and the scope thereof is determined by the claims that follow.

We claim:

1. A method of recovering lithium from a brine source, the method comprising:

extracting lithium from the brine source using an adsorption/desorption process during an extraction stage to form a lithium extract, wherein the extraction stage includes contacting a brine source stream with a lithium selective medium to load the medium with lithium and contacting an eluent stream with the lithium-loaded medium to form the lithium extract;

concentrating the lithium extract during a concentration stage to yield a lithium concentrate stream, wherein the concentration stage includes using a membrane separation process with a plurality of membrane separations in series operated in counter-current format, wherein the membrane separation process includes a low-lithium concentration stream and high-lithium concentration stream flowing from membrane to membrane in opposite sequential orientations, wherein a dilute brine stream is obtained from the low-lithium concentration stream;

recycling the dilute brine stream from the concentration stage to the eluent stream used during the extraction stage and/or to the brine source stream used during the extraction stage;

heating the lithium concentrate stream via a heat exchanger positioned downstream from the concentration stage to yield a heated lithium concentrate stream;

processing the heated lithium concentrate stream via a vaporizer positioned downstream from the heat exchanger, wherein a vaporized water stream and a lithium pre-conversion stream are obtained from a vaporization section of the vaporizer, the lithium pre-conversion stream comprising lithium salt, and wherein a precipitate stream precipitates in the vaporization section and settles in a precipitation section of the vaporizer, the precipitate stream comprising impurities; and channeling the vaporized water stream from the vaporizer to the heat exchanger positioned upstream from the vaporizer, wherein heat from the vaporized water stream is used via the heat exchanger to heat the lithium concentrate stream and yield the heated lithium concentrate stream that is then channeled to the vaporizer.

2. The method of claim 1, wherein the lithium concentrate stream is obtained from the high-lithium concentration stream.

3. The method of claim 1, comprising treating impurities of the dilute brine stream using an impurity removal process.

4. The method of claim 1, further comprising converting the lithium concentrate stream during a conversion stage, wherein lithium chloride from the lithium concentrate stream is converted to lithium carbonate and/or lithium hydroxide.

5. The method of claim 1, wherein a condensed water stream is obtained from the heat exchanger, and wherein the method further comprises adding a portion of the condensed water stream to the lithium pre-conversion stream downstream from the vaporizer.

6. The method of claim 5, further comprising converting lithium chloride in the lithium pre-conversion stream into lithium carbonate and/or lithium hydroxide during a conversion stage, wherein the portion of the condensed water stream is added to the lithium pre-conversion stream upstream from the conversion stage.

7. The method of claim 1, wherein the precipitate stream comprises sodium, calcium, potassium, magnesium, manganese, or a combination thereof.

8. The method of claim 1, further comprising:

channeling the precipitate stream from the precipitation section to a settling vessel;

separating the precipitate stream in the settling vessel to obtain an impurity stream and a water or a brine; and channeling the water or the brine from the settling vessel to the precipitation section of the vaporizer.

9. The method of claim 1, wherein the heated lithium concentrate stream is processed via the vaporizer using flash vaporization.

10. The method of claim 9, further comprising:

converting, in a first conversion stage, lithium chloride in the lithium pre-conversion stream into lithium carbonate to yield a first conversion stream comprising the lithium carbonate, wherein the first conversion stage comprises:

mixing, via a first mixing vessel, the lithium pre-conversion stream with a sodium carbonate stream to yield a first reaction mixture;

separating, via a first rotary separator, the first reaction mixture into the first conversion stream and a conversion recycle stream;

recycling the conversion recycle stream to mix with the lithium concentrate stream upstream from the vaporizer;

processing a first portion of the first conversion stream via at least one additional membrane separation process to reduce a water content of the first portion of the first conversion stream;

drying the first portion of the first conversion stream having the reduced water content to obtain a lithium carbonate stream; and channeling a second portion of the first conversion stream to a second conversion stage; and converting, in the second conversion stage, the lithium carbonate in the second portion of the first conversion stream into lithium hydroxide to yield a lithium hydroxide stream, wherein the second conversion stage comprises:

mixing, via a second mixing vessel, the second portion of the first conversion stream with a calcium hydroxide stream to yield a second reaction mixture;

separating, via a second rotary separator, the second reaction mixture into a calcium carbonate stream and the lithium hydroxide stream;

filtering the calcium carbonate stream to yield a solid calcium carbonate product;

processing the lithium hydroxide stream via the at least one additional membrane separation process to reduce a water content of the lithium hydroxide stream; and drying the lithium hydroxide stream having the reduced water content.

* * * * *